US005577894A

United States Patent [19]

Kawaguchi et al.

[11] Patent Number: 5,577,894

[45] Date of Patent: Nov. 26, 1996

[54] PISTON TYPE VARIABLE DISPLACEMENT COMPRESSOR

[75] Inventors: Masahiro Kawaguchi; Masanori Sonobe; Tomohiko Yokono; Ken Suitou, all of Kariya, Japan

[73] Assignee: Kabushiki Kaisha Toyoda Jidoshokki Seisakusho, Kariya, Japan

[21] Appl. No.: 334,814

[22] Filed: Nov. 4, 1994

Related U.S. Application Data

[63] Continuation-in-part of Ser. No. 255,043, Jun. 7, 1994.

[30] Foreign Application Priority Data

Nov. 5, 1993 [JP] Japan ..... 5-277176

[51] Int. Cl.[6] ..... F04B 1/29

[52] U.S. Cl. ..... 417/222.2; 417/295

[58] Field of Search ..... 417/222.1, 222.2, 417/269, 295, 516; 91/480, 499

[56] References Cited

U.S. PATENT DOCUMENTS

| | | | |
|---|---|---|---|
| 4,669,272 | 6/1987 | Kawai et al. | 62/228.3 |
| 4,691,526 | 9/1987 | Kobayashi et al. | 62/217 |
| 4,801,248 | 1/1989 | Tojo et al. | 417/222.2 |
| 4,867,649 | 9/1989 | Kawashima et al. | 417/222.2 |
| 5,032,060 | 7/1991 | Kobayashi et al. | 417/222.1 |
| 5,105,728 | 4/1992 | Hayase et al. | 417/222.2 |
| 5,173,032 | 12/1992 | Taguchi | 417/222.2 |

FOREIGN PATENT DOCUMENTS

| | | | |
|---|---|---|---|
| 363243468A | 10/1988 | Japan | 417/222.2 |
| 364056972A | 3/1989 | Japan | 417/222.2 |
| 401110879A | 4/1989 | Japan | 417/222.2 |
| 401138381A | 5/1989 | Japan | 417/222.2 |
| 402115576A | 4/1990 | Japan | 417/222.2 |

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A compressor has a refrigerant gas passage selectively connected to and disconnected from a refrigerant circuit separately provided from the compressor. The compressor has a plurality of pistons reciprocable in a housing for compressing refrigerant gas. A drive shaft is rotatably supported by the housing. A swash plate is supported on the drive shaft for integral rotation with inclining motion with respect to the drive shaft to drive the pistons. The swash plate is movable between a maximum inclined angle and a minimum inclined angle. A disconnecting member disconnects the refrigerant circuit from the refrigerant gas passage when the swash plate is at the minimum inclined angle. A bleed hole bleeds the refrigerant gas from the refrigerant gas passage to the refrigerant circuit to suppress rapid increase of the inclined angle when the disconnecting member operates.

28 Claims, 10 Drawing Sheets

PISTON TYPE VARIABLE DISPLACEMENT COMPRESSOR

CROSS REFERENCE TO RELATED APPLICATION

This application is a continuation in part of U.S. application Ser. No. 08/255,043 filed on Jun. 7, 1994, now allowed entitled SWASH PLATE TYPE COMPRESSOR.

BACKGROUND OF THE INVENTION

1. Field of the Invention

The present invention relates to a clutchless piston type variable displacement compressor, and more particularly, to a clutchless piston type variable displacement compressor which controls the inclined angle of a swash plate by utilizing the pressure differential between a crank chamber and a suction chamber to supply gas in a discharge pressure area to the crank chamber and to discharge the gas in the crank chamber to a suction pressure area, thereby adjusting the pressure in the crank chamber.

2. Description of the Related Art

In general, compressors are used in vehicles to supply compressed refrigerant gas to the vehicle's air conditioning system. To maintain air temperature inside the vehicle at a level comfortable for passengers in the vehicle, it is important to utilize a compressor having a controllable displacement. One known compressor of this type controls the inclined angle of a swash plate, tiltably supported on a rotary shaft, based on the difference between the pressure in a crank chamber and the suction pressure, and converts the rotational motion of the swash plate to the reciprocal linear motion of each piston.

In the conventional compressor, an electromagnetic clutch is provided between an external driving source, such as the vehicle's engine, and the rotary shaft of the compressor. Power transmission from the driving source to the rotary shaft is controlled by the ON/OFF action of this clutch. When power transmission from the driving source to the rotary shaft is interrupted, the compressor's displacement of refrigerant gas is set to zero. At the time when the electromagnetic clutch is activated or deactivated, the clutch's action generates a shock generally detrimental not only to the compressor but also to the overall driving comfort experienced by the vehicle's passengers. Further, the provision of the electromagnetic clutch increases the overall weight of the compressor.

To solve the above shortcoming, U.S. Pat. No. 5,173,032 issued Dec. 22, 1992 to Taguchi et al., discloses a compressor designed to set the displacement amount to zero without using an electromagnetic clutch. In such a clutchless system, the compressor runs even when no cooling is needed. With such type of compressors, it is important that when cooling is unnecessary, the discharge displacement be reduced as much as possible to prevent the evaporator from undergoing frosting. Under these conditions, it is also important to stop the circulation of the refrigerant gas through the compressor, and its external refrigerant circuit.

The compressor described in U.S. Pat. No. 5,173,032 is designed to block the flow of gas into the suction chamber in the compressor from the external refrigerant circuit by the use of an electromagnetic valve. This valve selectively allows for the circulation of the gas through the external refrigerant circuit and the compressor. When the gas circulation is blocked by the valve, the pressure in the suction chamber drops and the control valve responsive to that pressure completely opens. This complete opening of the control valve allows the gas in the discharge chamber to flow into the crank chamber, which in turn raises the pressure inside the crank chamber. The gas in the crank chamber is supplied to the suction chamber. Accordingly, a short circulation path is formed which passes through the cylinder bores, the discharge chamber, the crank chamber, the suction chamber and back to the cylinder bores.

As the pressure in the suction chamber decreases, the suction pressure in the cylinder bores falls, causing an increase in the difference between the pressure in the crank chamber and the suction pressure in the cylinder bores. This pressure differential in turn minimizes the inclination of the swash plate which reciprocates the pistons. As a result, the discharge displacement and the driving torque needed by the compressor are minimized, thus reducing power loss as much as possible when cooling is unnecessary.

The aforementioned electromagnetic valve performs a simple ON/OFF action to instantaneously stop the gas flow from the external refrigerant circuit into the suction chamber. Naturally, when the valve is off, the amount of gas supplied into the cylinder bores from the suction chamber decreases drastically. This rapid decrease in the amount of gas flowing into the cylinder bores likewise causes a rapid decrease in the discharge displacement and discharge pressure. Consequently, the driving torque needed by the compressor is drastically reduced over a short period of time.

When the electromagnetic valve switches to the ON position, the gas flow from the external refrigerant circuit to the suction chamber instantaneously starts again. Accordingly, the amount of gas supplied to the cylinder bores from the suction chamber quickly increases and the discharge displacement and discharge pressure quickly increase. Consequently, the driving torque needed by the compressor undergoes a rapid rise over a short period of time. This variation in torque caused by the ON/OFF action of the electromagnetic valve, however, prevents shock suppression which is the primary purpose of the clutchless system.

SUMMARY OF THE INVENTION

Accordingly, it is a primary object of the present invention to suppress shocks caused by a variation in driving torque needed by a compressor.

It is another object of this invention to prevent an evaporator in an external refrigerant circuit from undergoing frosting.

To achieve the above objects, a compressor has a refrigerant gas passage selectively connected to and disconnected from a refrigerant circuit separately provided from the compressor. The compressor has a plurality of pistons reciprocable in a housing for compressing refrigerant gas. A drive shaft is rotatably supported by the housing. A swash plate is supported on the drive shaft for integral rotation with inclining motion with respect to the drive shaft to drive the pistons. The swash plate is movable between a maximum inclined angle and a minimum inclined angle. A disconnecting means disconnects the refrigerant circuit from the refrigerant gas passage when the swash plate is at the minimum inclined angle. A bleeding means bleeds the refrigerant gas from the refrigerant gas passage to the refrigerant circuit to suppress rapid increase of the inclined angle when the disconnecting means operates.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A swash plate type variable displacement compressor according to a first embodiment of the present invention will now be described referring to FIGS. 1 through 8.

Figure 1:
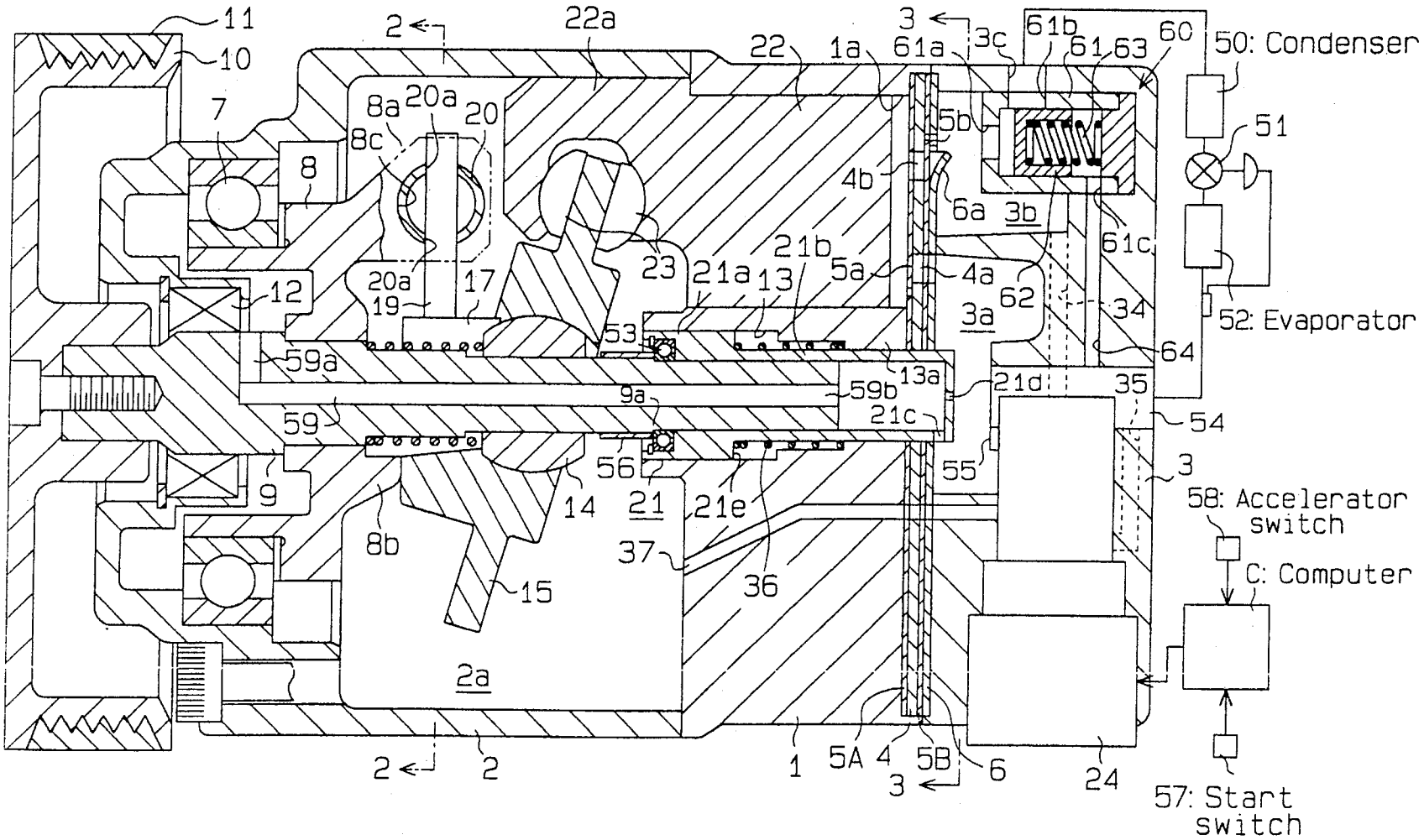
FIG. 1 is a side cross-sectional view of an overall compressor according to one embodiment of the present invention.
Figure 3:
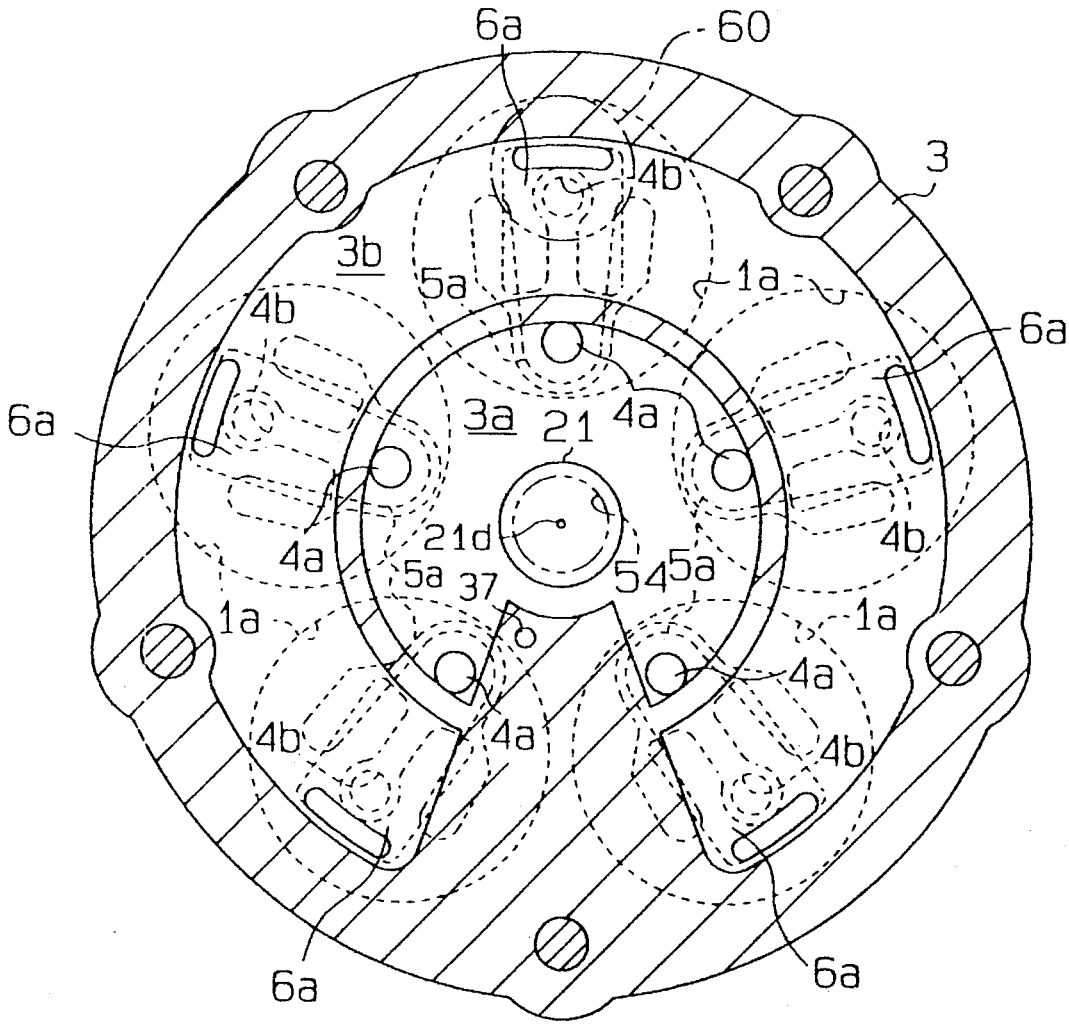
FIG. 3 is a cross section taken along the line 3—3 in FIG. 1.
Figure 4:
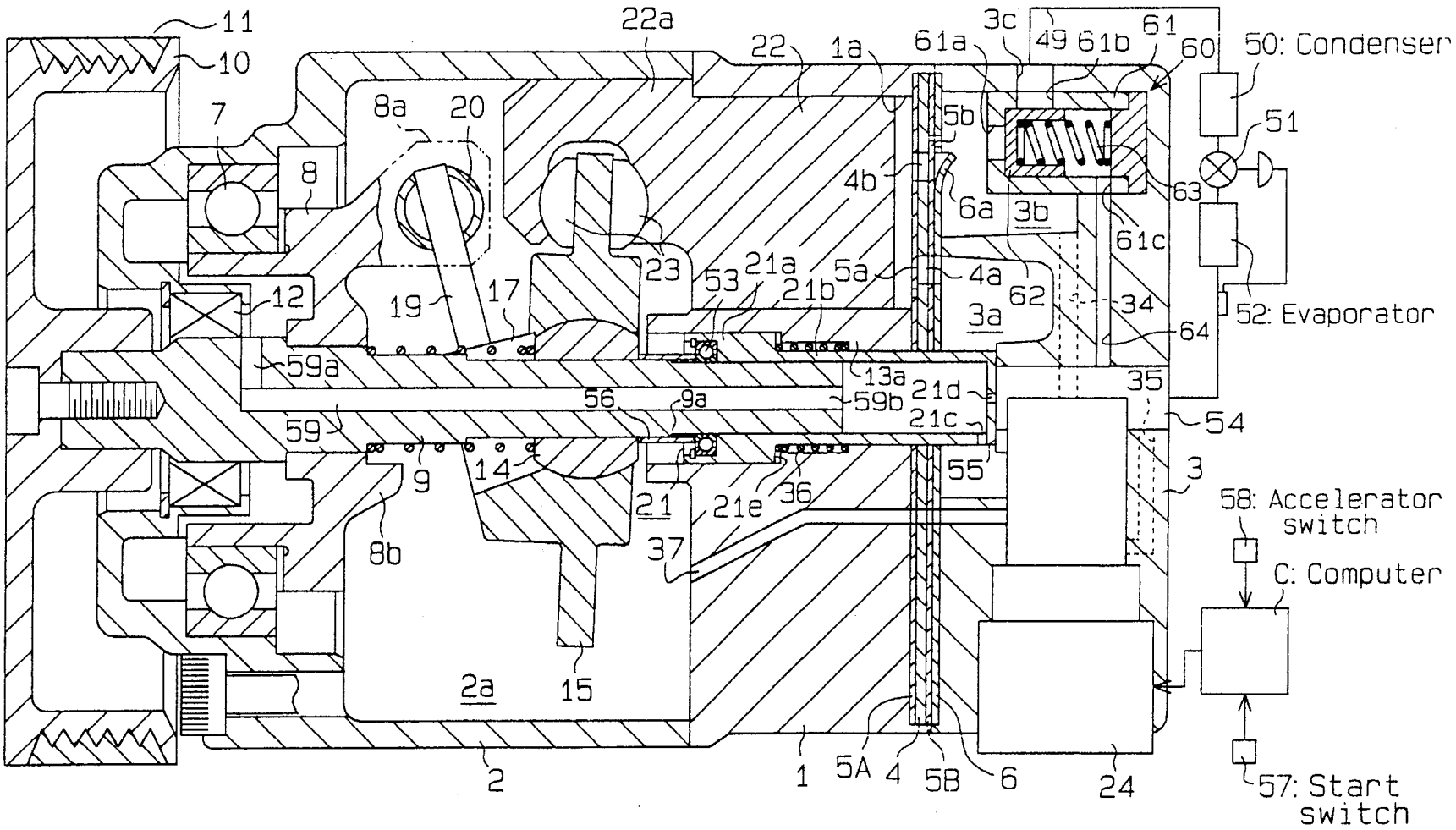
FIG. 4 is a side cross-sectional view of the whole compressor with its swash plate at the minimum inclined angle.

As shown in FIGS. 1 and 4, a front housing 2 and a rear housing 3 are secured to a cylinder block 1. The cylinder block 1, front housing 2 and rear housing 3 constitute a housing of the compressor. Secured between the cylinder block 1 and the rear housing 3 are a first plate 4, a second plate 5A, a third plate 5B and a fourth plate 6. A crank chamber 2*a* is defined in the front housing 2 between the cylinder block 1 and the front housing 2. As shown in FIGS. 1, 3 and 4, a suction chamber 3*a* and a discharge chamber 3*b* are defined at the center portion and peripheral portion of the rear housing 3.

A ball bearing 7 is attached inside the front housing 2. A drive plate 8 is supported by the inner race of the ball bearing 7, and a drive shaft 9 is secured to the drive plate 8. By means of the drive plate 8, the ball bearing 7 receives the thrust load and radial load which act on the drive shaft 9.

The drive shaft 9 protrudes outside the front housing 2, with a pulley 10 fixed to the protruding portion. The pulley 10 is coupled to a vehicle's engine (not shown) via a belt 11. No electromagnetic clutch intervenes between the pulley 10 and the engine. A lip seal 12 is located between the drive shaft 9 and the front housing 2 to prevent a pressure leak from the crank chamber 2*a*.

A support 14 having a convex surface is supported on the drive shaft 9 in such a way as to be slidable along the axial direction of the drive shaft 9. The support 14 provides support for a swash plate 15 and allows it to tilt at the center of the support 14 where the swash plate 15 is concave.

Figure 2:
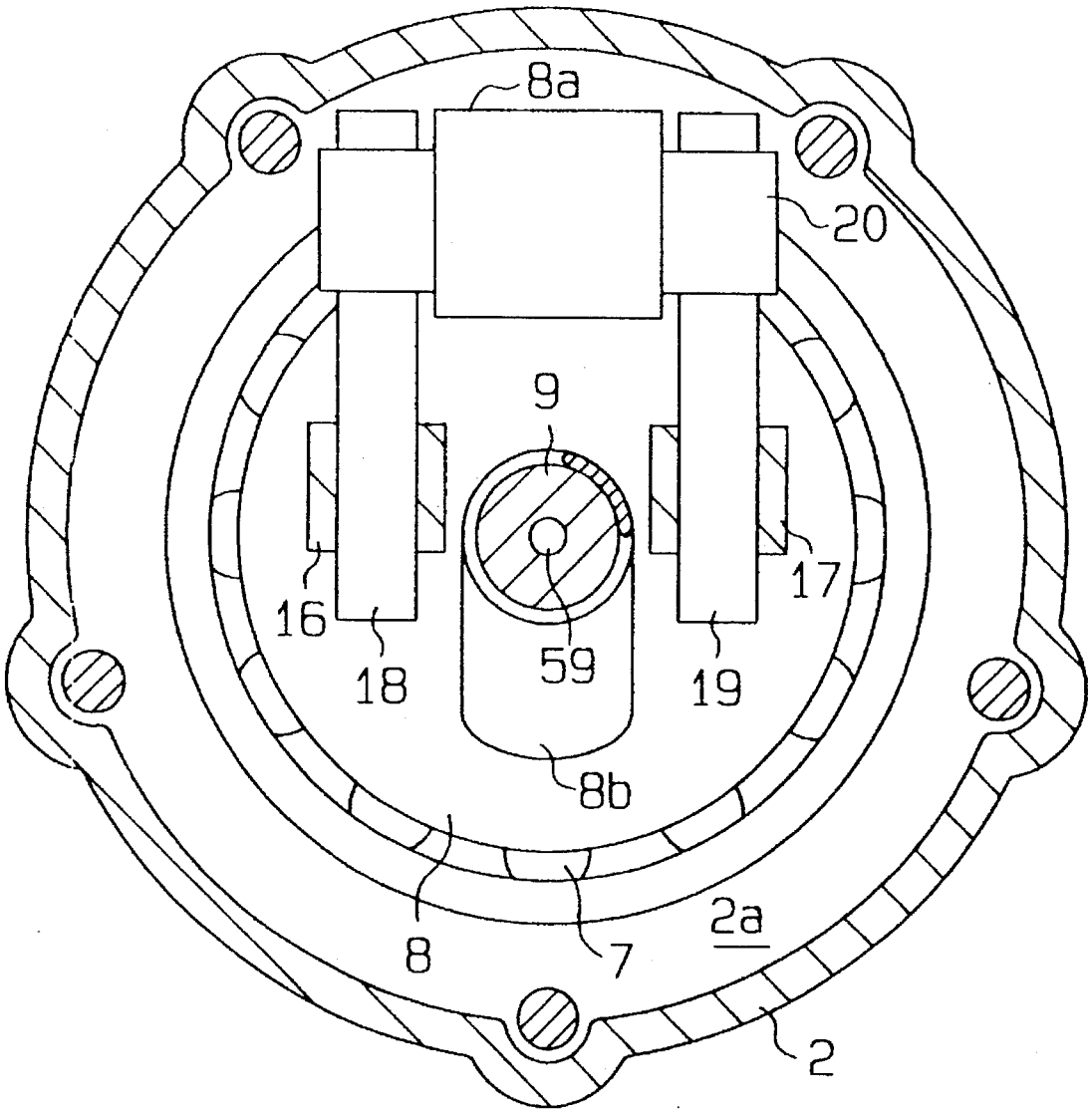
FIG. 2 is a cross section taken along the line 2—2 in FIG. 1.

As shown in FIGS. 1 and 2, a pair of stays 16 and 17 are securely attached to the swash plate 15, with pins 18 and 19 respectively secured to the stays 16 and 17. The drive plate has a protruding arm 8*a* in which a hole 8*c* is formed extending in the direction perpendicular to the axis of the drive shaft 9. A pipe-shaped connector 20, rotatable about its axis, is inserted in the hole 8*c*. A pair of holes 20*a* are formed in the cylindrical wall of the connector 20, and the pins 18 and 19 are fitted slidably in the respective holes 20*a*.

The swash plate 15 rotates together with the drive plate 8 and the drive shaft 9 by the coupling of the pins 18 and 19 to the connector 20. When the swash plate 15 tilts, the connector 20 rotates about its axis and the pins 18 and 19 move in the holes 20*a* along their axes.

Figure 5:
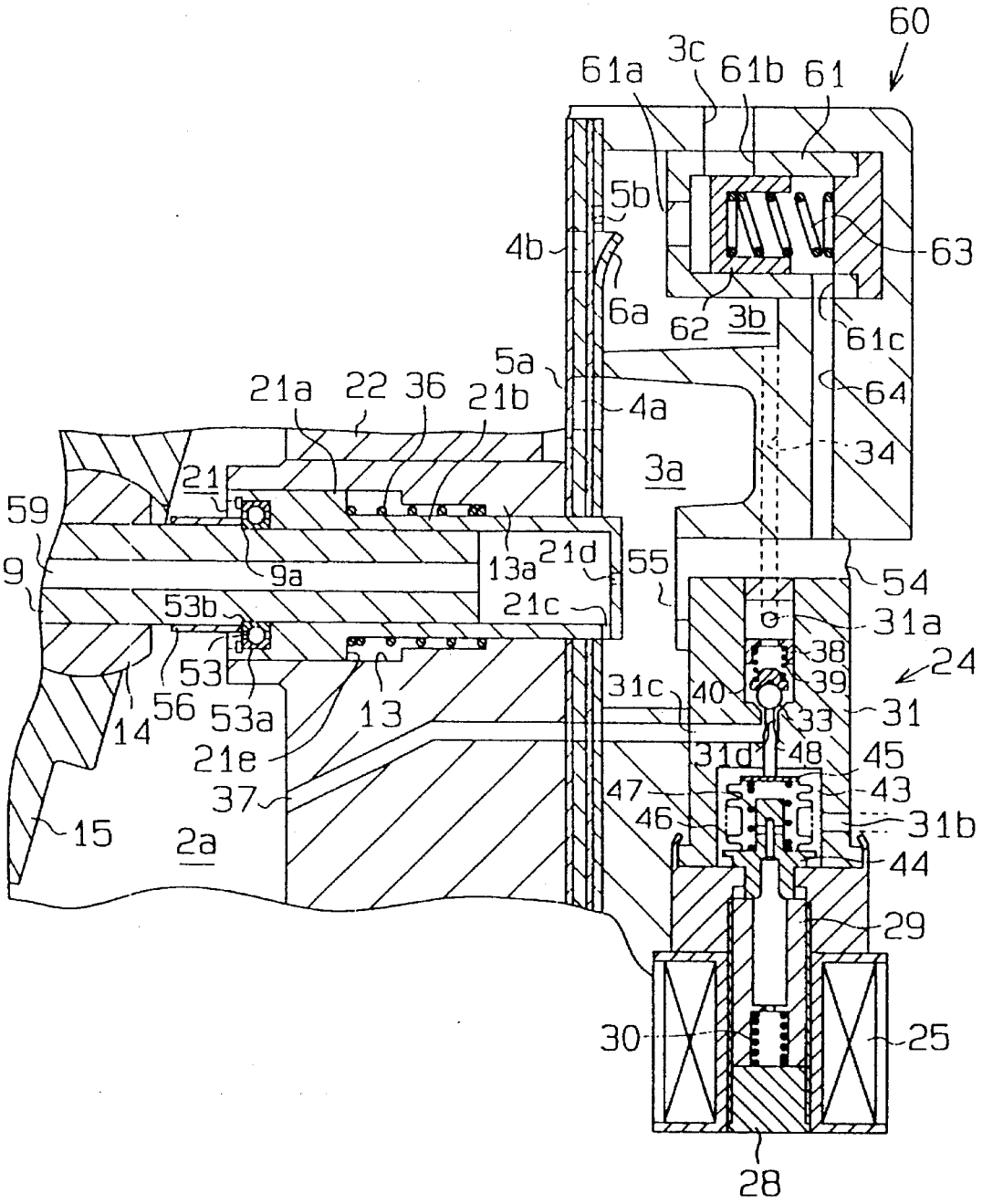
FIG. 5 is an enlarged fragmentary cross-sectional view showing a suction passage opened by a spool.

As shown in FIGS. 1, 4 and 5, a retainer hole 13 is formed in the center of the cylinder block 1 and extends along the axis of the drive shaft 9. A cylindrical spool 21 having an end wall is slidably retained in the retainer hole 13.

A flange 13*a* is formed on the inner wall of the retainer hole 13. The spool 21 has a large diameter portion 21*a* and a small diameter portion 21*b* between which a step 21*e* is formed. A spring 36 is disposed between the step 21*e* and the flange 13*a* to press the spool 21 toward the support 14. The small diameter portion 21*b* of the spool 21 protrudes into the suction chamber 3*a*.

The drive shaft 9 is fitted inside the spool 21. A ball bearing 53 is located between the drive shaft 9 and the spool 21. The drive shaft 9 is supported on the inner wall of the retainer hole 13 via the ball bearing 53 and spool 21. The ball bearing 53 has an outer race 53*a* secured to the inner wall of the spool 21, and has an inner race 53*b* which is slidable on the outer surface of the drive shaft 9.

As shown in FIG. 5, a restricting surface 55 is formed on the inner wall of the suction chamber 3*a*, facing the bottom wall of the spool 21. A step 9*a* is formed at the outer surface of the drive shaft 9. The spool 21 is movable between a position where it abuts on the restricting surface 55 and a position where the inner race 53*b* of the ball bearing 53 abuts on the step 9*a*.

A suction passage 54 is formed in the center of the rear housing 3 and communicates with the retainer hole 13 via the suction chamber 3*a*. The restricting surface 55 is located around the inner-end opening of the suction passage 54. When the spool 21 abuts on the restricting surface 55, the communication between the suction passage 54 and the retainer hole 13 is substantially blocked due to the bleed hole 21*d*.

A pipe 56 is slidably provided on the drive shaft 9 between the support 14 and the ball bearing 53. When the support 14 moves toward the spool 21, the inner race 53*b* of the ball bearing 53 is pushed via the pipe 56, as apparent from FIGS. 5 and 6. Consequently, the spool 21 moves toward the restricting surface 55 against the force of the spring 36.

The minimum inclined angle of the swash plate 15 is determined according to the abutment of the spool 21 on the restricting surface 55. The minimum inclined angle is slightly larger than zero degrees with respect to a plane perpendicular to the drive shaft 9. On the other hand, the maximum inclined angle of the swash plate 15 is determined according to the abutment of a projection 8*b* of the drive plate 8 on the swash plate 15.

Pistons 22 are respectively placed in a plurality of cylinder bores 1*a* formed in the cylinder block 1. A pair of shoes 23 are fitted in a neck 22*a* of each piston 22. The swash plate 15 is disposed between both shoes 23. The undulating movement of the swash plate 15 caused by the rotation of the drive shaft 9 is transmitted via the shoes 23 to each piston 22. This causes linear reciprocation of the pistons 22.

As shown in FIGS. 1 and 3, a suction port 4*a* and a discharge port 4*b* are formed in the first plate 4. A suction valve 5*a* is provided on the second plate 5A, and a discharge valve 5*b* is provided on the third plate 5B.

The gas in the suction chamber 3*a* pushes the suction valve 5*a* and enters the cylinder bore la through the suction port 4*a* in accordance with the backward movement of the piston 22. The gas that has entered the cylinder bore 1*a* is compressed by the forward movement of the piston 22, and is then discharged to the discharge chamber 3*b* via the discharge port 4*b* while pushing the discharge valve 5*b*. Any excessive opening motion of the discharge valve 5*b* is inhibited by a retainer 6*a* on the fourth plate 6.

The stroke of the pistons 22, and consequently, the inclined angle of the swash plate 15, varies in accordance with the change of pressure differential between the pressure in the crank chamber 2*a* and the suction pressure in each cylinder bore 1*a*.

A refrigerant gas passage 59 is formed within the drive shaft 9, and has an inlet 59*a* which opens to the crank chamber 2*a* in the neighborhood of the lip seal 12. An outlet 59*b* of the passage 59 opens to the inside of the spool 21. As shown in FIGS. 1, 4 and 5, a pressure release hole 21*c* is formed in the wall of the spool 21, and a bleed hole 21*d* is formed in the end wall of the spool 21. The area of the cross section of the bleed hole 21*d* is smaller than that of the pressure release hole 21*c*. The pressure release hole 21*c* permits the suction chamber 3*a* to communicate with the interior of the spool 21. Consequently, the crank chamber 2*a* is connected to the suction chamber 3*a* via a pressure release passage, which is formed by the refrigerant gas passage 59, the interior of the spool 21 and the pressure release hole 21*c*. The refrigerant gas flowing from the crank chamber 2*a* to the suction chamber 3*a* undergoes restriction at the pressure release hole 21*c*.

A discharge control valve 60 is retained in the discharge chamber 3*b* to control the pressure inside the chamber 3*b*. A first port 61*a*, a second port 61*b* and a third port 61*c* are formed in a valve housing 61 of the control valve 60. The first port 61*a* is connected to the discharge chamber 3*b*, and the second port 61*b* is connected to an exhaust port 3*c*. The third port 61*c* is connected via a passage 64 to the suction passage 54. A valve body 62 in the valve housing 61 is urged by a spring 63 toward a position to close the first port 61*a* and the second port 61*b*.

Discharge pressure Pd in the discharge chamber 3*b* acts on the valve body 62 in the direction to open the first port 61*a* and the second port 61*b*. Suction pressure Ps in the suction passage 54 acts on the valve body 62 in the direction to close the first port 61*a* and the second port 61*b*. In other words, the discharge pressure Pd acts on the valve body 62 against the combined urging force of the spring 63 and the suction pressure Ps. When the difference between the discharge pressure Pd and the suction pressure Ps becomes equal to or lower than a predetermined value ΔP, the valve body 62 closes the first port 61*a* and the second port 61*b*.

A control valve 24 for controlling the pressure inside the crank chamber 2*a* will now be described with reference to FIGS. 5 through 7. The control valve 24 is attached to the rear housing 3. This valve 24 has a fixed iron core 28 and a movable iron core 29. The movable iron core 29 is urged away from the fixed iron core 28 by the force of a spring 30. When a solenoid 25 is activated, the movable iron core 29 moves against the force of the spring 30 to be attracted to the fixed iron core 28.

A spherical valve body 33 is placed in a valve housing 31. A fourth port 31*a*, a fifth port 31*b* and a control port 31*c* are formed in the valve housing 31. The fourth port 31*a* is connected via a passage 34 to the discharge chamber 3*b*, and the fifth port 31*b* is connected via a passage 35 shown in FIG. 1 to the suction passage 54. The control port 31*c* is connected via a control passage 37 to the crank chamber 2*a*. A return spring 39 and a valve seat 40 intervene between a spring retainer 38 in the housing 31 and the valve body 33. The valve body 33 receives the force of the return spring 39 that acts in the direction to close a valve hole 31*d*.

A metal bellows 44 is secured to the movable iron core 29. The metal bellows 44 is disposed in a suction pressure detecting chamber 43 which communicates with the fifth port 31*b*. The metal bellows 44 and a spring retainer 45 are connected by a bellows 46, with a spring 47 disposed between the metal bellows 44 and the spring retainer 45. A connection rod 48 is secured to the spring retainer 45 in such a way that its distal end abuts on the valve body 33. The valve body 33 opens or closes the valve hole 31*d* in accordance with a change in suction pressure in the detecting chamber 43. When the valve hole 31*d* is closed, the communication between the fourth port 31*a* and the control port 31*c* is blocked.

Figure 8:
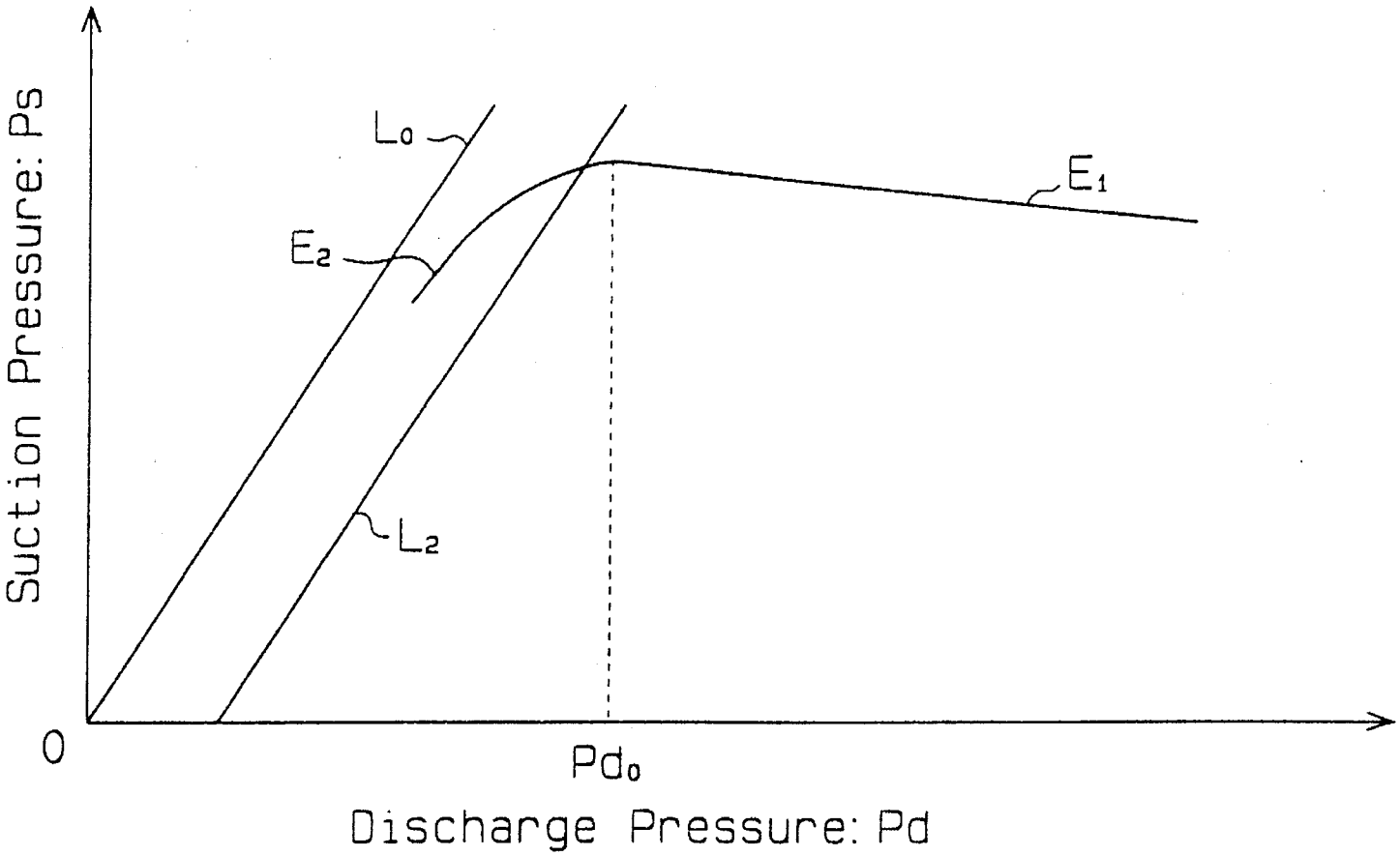
FIG. 8 is a graph showing the pressure control characteristics of a displacement control valve and a discharge control valve in accordance with the invention.

A curve $E_1$ in FIG. 8 illustrates the relationship between the discharge pressure Pd and the suction pressure Ps, both of which are controlled by control valve 24 when solenoid 25 is activated. A straight line $L_0$ represents the equation Ps=Pd.

When $Pd>Pd_0$, the curve $E_1$ is expressed by the following equation.

$$Ps=P0-(Pd-Pc)S1/S2$$

where P0 is the sum of the force of the spring 47 acting on the spring retainer 45 and the atmospheric pressure, S1 is the area of the cross section of the valve hole 31*d* and S2 is the area of the spring retainer 45.

When the discharge pressure Pd is equal to or greater than $Pd_0$, the suction pressure Ps decreases with an increase in discharge pressure Pd. With the discharge pressure Pd equal to or greater than $Pd_0$, the valve body 33 closes the valve hole 31*d* in the area above the curve $E_1$, and opens the valve hole 31*d* in the area under the curve $E_1$. Therefore, the displacement of the compressor is controlled by controlling the discharge pressure Pd and the suction pressure Ps based on the curve $E_1$.

When the discharge pressure Pd is equal to or lower than $Pd_0$, the relation between the discharge pressure Pd and the suction pressure Ps is expressed by a curve $E_2$. That is, when the discharge pressure Pd becomes lower than $Pd_0$, the amount of the refrigerant gas passing the valve hole 31*d* becomes small and the suction pressure Ps starts dropping. Accordingly, the valve 33 is fully opened and the inclined angle of the swash plate 15 is minimized, disabling the displacement control by the control valve 24.

The line L1 represents the relation of Ps=Pd−ΔP. In the region between two lines $L_0$ and L1, the discharge control valve 60 is closed. In the region right to the line L1, the discharge control valve 60 opens the first and second ports 61*a* and 61*b*.

A description will now be given of an apparatus for controlling the operations of the compressor and an external refrigerant circuit 49 connected to the compressor. The aforementioned suction passage 54 and exhaust port 3*c* are connected together by the external refrigerant circuit 49. The external refrigerant circuit 49 has a condenser 50, an expansion valve 51 and an evaporator 52. The expansion valve 51 regulates the flow rate of the refrigerant gas in accordance with a change in the gas pressure on the outlet side of the evaporator 52.

The solenoid 25 is controlled by a computer C. The computer C excites the solenoid 25 when a start switch 57 for activating the vehicle's air conditioner is turned on or when an accelerator switch 58 for the vehicle is turned off. The computer C deexcites the solenoid 25 when the start switch 57 is turned off or the accelerator switch 58 is turned on. FIG. 5 shows the activated solenoid 25. At this time, the movable iron core 29 is attracted to the fixed iron core 28 against the force of the spring 30, as shown in FIG. 5.

With the solenoid 25 excited, the bellows 46 changes in accordance with a variation in suction pressure Ps supplied to the detecting chamber 43 via the suction passage 54 and passage 35 (see FIG. 1), and this displacement is transmitted via the connection rod 48 to the valve body 33. When the suction pressure Ps is higher than the predetermined suction pressure on the curve $E_1$, i.e., when the cooling load is large, the valve hole 31*d* becomes restricted by the valve body 33. The refrigerant gas in the crank chamber 2*a* flows out to the suction chamber 3*a* via the refrigerant gas passage 59. This minimizes the amount of the refrigerant gas flowing into the crank chamber 2*a* from the discharge chamber 3*b* via the passage 34, the port 31*a*, the valve hole 31*d*, the control port 31*c* and the control passage 37. As a consequence, the pressure in the crank chamber 2*a* falls. When the suction pressure Ps is high, the pressure in the cylinder bores 1*a* is also high so that the difference between the pressure in the crank chamber 2*a* and the pressure in the cylinder bores 1*a* decreases. Therefore, the inclined angle of the swash plate 15 becomes large as shown in FIGS. 1 and 5. At this time, the first and second ports 61*a* and 61*b* are opened by the discharge control valve 60.

On the other hand, when the suction pressure Ps is lower than the predetermined suction pressure on the curve $E_1$, i.e., when the cooling load is small, the valve hole 31*d* is opened by the valve body 33. As a result, the amount of the refrigerant gas flowing into the crank chamber 2*a* from the discharge chamber 3*b* increases, raising the pressure in the crank chamber 2*a*. The pressure in the cylinder bores 1*a*, like the suction pressure Ps, is low, so that the difference between the pressure in the crank chamber 2*a* and the suction pressure in the cylinder bores 1*a* increases. This reduces the inclined angle of the swash plate 15.

When the suction pressure is very low or the cooling load approaches zero, the difference between the discharge pressure Pd and the suction pressure Ps becomes equal to or lower than the predetermined value ΔP. The discharge control valve 60 closes the associated ports 61*a* and 61*b*. This inhibits the flow of the refrigerant gas to the external refrigerant circuit 49 from the discharge chamber 3*b*. Since the difference between the discharge pressure Pd and the suction pressure Ps does not, in a short period of time, undergo any drastic change, the control valve 60 gradually closes the ports 61*a* and 61*b*. Because the amount of the refrigerant gas that flows into the suction chamber 3*a* from the external refrigerant circuit 49 does not decrease rapidly, the amount of the refrigerant gas supplied into the cylinder bores 1*a* from the suction chamber 3*a* gradually decreases. Thus, the discharge displacement in turn gradually decreases. As a result, the discharge pressure will not undergo any rapid fall nor will the torque in the compressor experience any great change over a short period of time.

Figure 6:
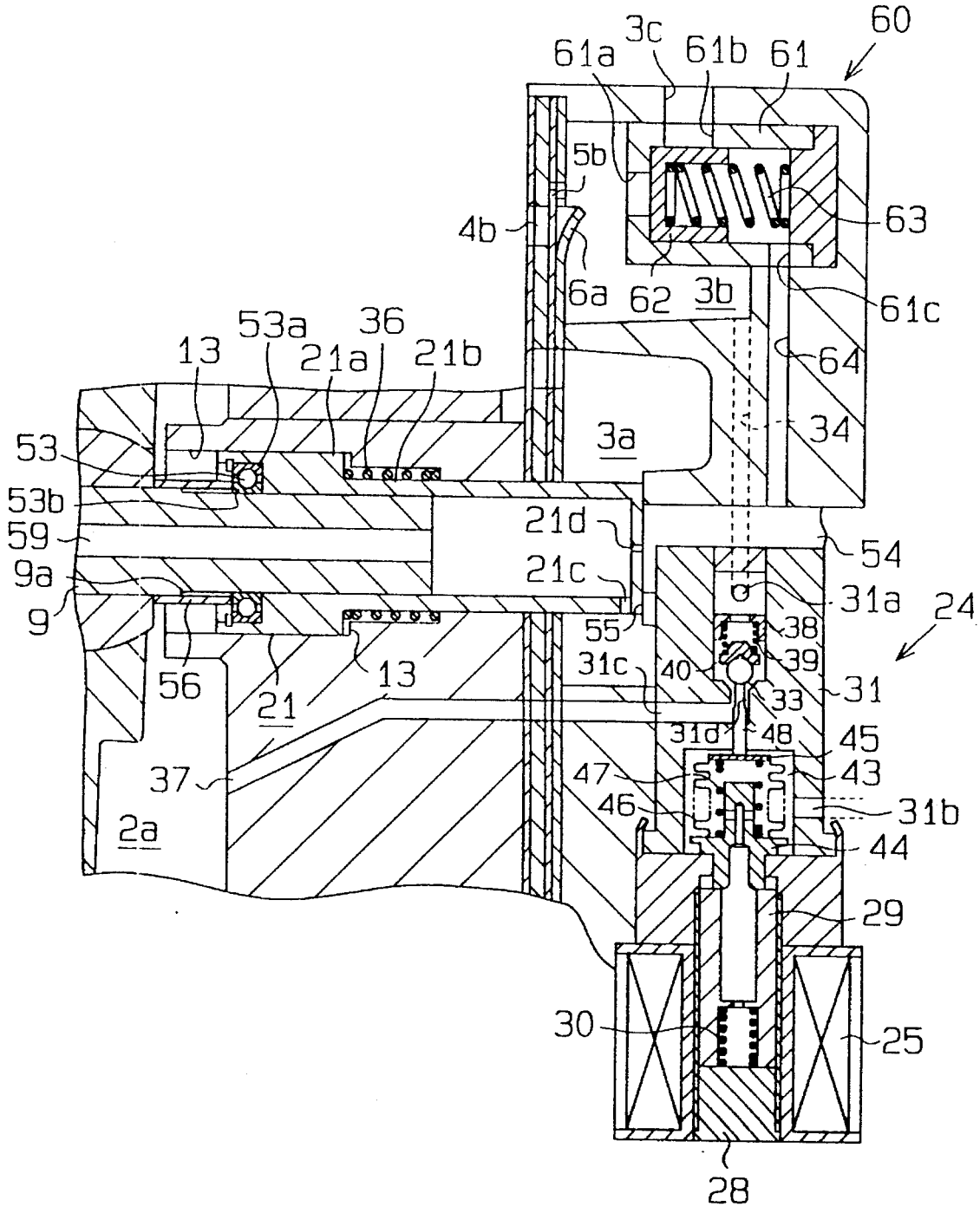
FIG. 6 is an enlarged fragmentary cross-sectional view showing the suction passage closed by the spool.
Figure 7:
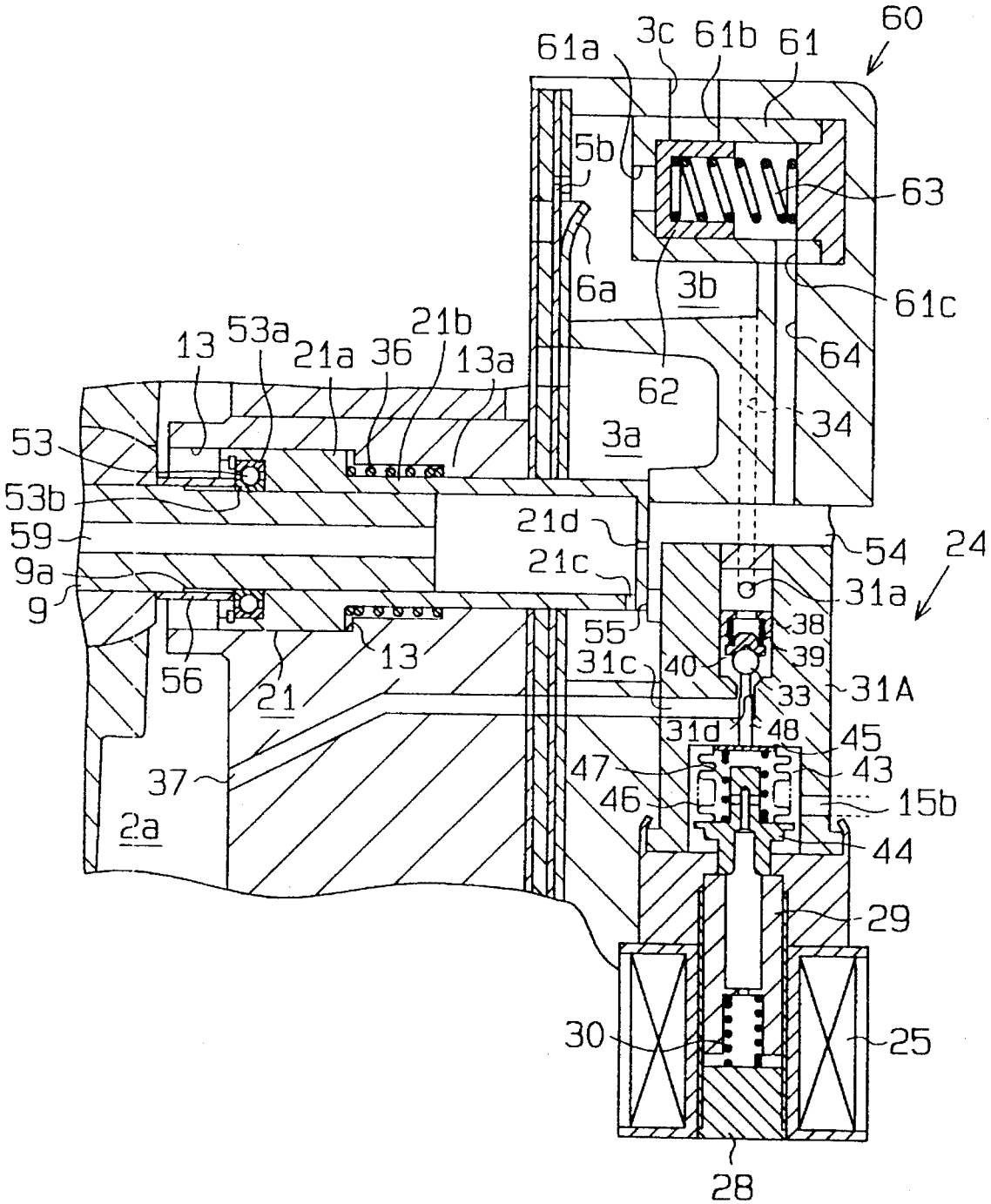
FIG. 7 is an enlarged fragmentary cross-sectional view showing the suction passage closed and a deactivated solenoid.

When the suction pressure becomes very low, the valve body 33 shown in FIG. 6 fully opens the valve hole 31*d*. With the valve hole 31*d* fully open, the refrigerant gas in the discharge chamber 3*b* swiftly flows into the crank chamber 2*a*. This raises the pressure in the crank chamber 2*a* quickly to the maximum level, which minimizes the inclined angle of the swash plate 15.

When the inclined angle of the swash plate 15 becomes smaller, the support 14 moves toward the spool 21 and abuts on the pipe 56. As a result, the pipe 56 is held between the support 14 and the inner race 53*b*. As the pipe 56 abuts only on the inner race 53*b* with respect to the ball bearing 53, the drive shaft 9, support 14, pipe 56 and inner race 53*b* rotate together, thus preventing the support 14, pipe 56 and inner race 53*b* from sliding against one another.

When the support 14 moves further toward the spool 21 with the pipe 56 abutting on the ball bearing 53, the distal end of the small diameter portion 21*b* of the spool 21 approaches the restricting surface 55, reducing the distance therebetween. This reduces the amount of the refrigerant gas flowing from the suction passage 54 into the suction chamber 3*a* and thus into the cylinder bores 1*a*, so that the displacement amount gradually decreases. Consequently, even when the spool 21 abuts on the restricting surface 55, the discharge pressure will not fall drastically nor will the torque in the compressor vary significantly over a short period of time.

When the spool 21 abuts on the restricting surface 55, the suction passage 54 communicates with the suction chamber 3*a* via the bleed hole 21*d*, the interior of the spool 21 and the pressure release hole 21*c*. Since the minimum inclined angle of the swash plate 15 is not zero degrees, refrigerant gas is discharged to the discharge chamber 3*b* from the cylinder bores 1*a* even with the swash plate 15 at the minimum angle as shown in FIGS. 4 and 6. The discharge pressure at this time lies between the two lines $L_0$ and L1 in FIG. 8. With the minimum angle of the swash plate 15, therefore, the ports 61*a* and 61*b* are closed by the discharge control valve 60, preventing the refrigerant gas from flowing out to the external refrigerant circuit 49 from the discharge chamber 3*b*. The refrigerant gas will therefore not circulate in the external refrigerant circuit 49, and frosting is unlikely to occur in the evaporator 52.

When the solenoid 25 is deactivated by the OFF action of the start switch 57 or the ON action of the accelerator switch 58, the movable iron core 29 moves away from the fixed iron core 28 by the force of the spring 30. The valve body 33 will then open the valve hole 31*a* to the maximum level, as shown in FIG. 7. Accordingly, the swash plate 15 moves in such a way as to minimize its inclined angle, during which the discharge control valve 60 closes the ports 61*a* and 61*b*. In this situation, i.e., when the swash plate 15 is at a minimized inclined angle, discharge pressure will not undergo any rapid fall off nor will the torque in the compressor significantly vary over a short period of time.

The action of the bleed hole 21*d* of the spool 21 will now be discussed.

The refrigerant gas discharged to the discharge chamber 3*b* from the cylinder bores 1*a* flows to the crank chamber 2*a* via the passage 34, the passage in the control valve 24 and the control passage 37. The refrigerant gas in the crank chamber 2*a* flows into the suction chamber 3*a* via the refrigerant gas passage 59. This gas is, in turn, led into the cylinder bores 1*a* from which it is discharged to the discharge chamber 3*b*. In other words, with the swash plate 15 at a minimally inclined angle, the circulation passage connecting the discharge chamber 3*b*, the passage 34, the passage in the control valve 24, the control passage 37, the crank chamber 2*a*, the passage 59, the suction chamber 3*a* and the cylinder bores 1*a* is formed in the compressor. Differences, moreover, exist among the pressures in the discharge chamber 3b, the crank chamber 2a and the suction chamber 3a.

Even with the minimum angle of the swash plate 15 and the spool 21 abutting on the restricting surface 55, the suction passage 54 is connected to the suction chamber 3a via the bleed hole 21d, the interior of the spool 21 and the pressure release hole 21c in this embodiment as mentioned above.

If the bleed hole 21d were not provided and the communication between the suction passage 54 and the suction chamber 3a were blocked, the refrigerant gas would not flow into the suction chamber 3a from the external refrigerant circuit 49. Pressure would in this case be rapidly released from the crank chamber 2a via the passage 59 and the pressure release hole 21c. This, in turn, would quickly reduce the pressure in the crank chamber 2a. Consequently, the swash plate 15 would move from a minimum to a maximum inclined angle position, causing the spool 21 to move, and restoring communication between the suction passage 54 and the suction chamber 3a. As a result, the refrigerant gas in the external refrigerant circuit 49 would flow into the suction chamber 3a, increasing the suction pressure and discharge pressure. The increase in discharge pressure would influence the pressure in the crank chamber 2a via the control passage 37, raising the pressure in this chamber 2a. The inclined angle of the swash plate 15 would then decrease again.

When the force to change the inclined angle of the swash plate 15 rapidly acts on the swash plate 15, hunting may occur on the swash plate 15. This hunting results in power loss. Moreover, a variation in discharge pressure may also cause hunting on the discharge control valve 60. When the hunting of the discharge control valve occurs, the refrigerant gas flows in the external refrigerant circuit 49, which is likely to cause frosting in the evaporator 52.

According to this embodiment, by way of contrast, even with the minimum inclined angle of the swash plate 15, the suction chamber 3a is connected via the bleed hole 21d to the suction passage 54, allowing the refrigerant gas in the external refrigerant circuit 49 to flow into the suction chamber 3a. When the spool 21 abuts on the restricting surface 55, therefore, no rapid pressure release from the crank chamber 2a via the refrigerant gas passage 59 and the pressure release hole 21c is carried out. Thus, the swash plate 15 will not quickly move to the position of the maximum inclined angle from the position of the minimum inclined angle, preventing hunting of the swash plate 15.

Generally, it is known that when the inclined angle of the swash plate is minimum, the discharge pressure is relatively stable. If the minimum inclined angle is set large, the undulation of the discharge pressure increases, while if the minimum inclined angle is set small, the undulation of the discharge pressure decreases. The minimum displacement of the compressor depends on the discharge pressure. Based on those facts, the predetermined value $\Delta P$ is determined in accordance with the minimum displacement of the compressor.

As shown in FIG. 6, when the cooling load increases and the suction pressure rises with the swash plate 15 at the minimum inclined angle, the bellows 46 in the detecting chamber 43 contracts. This causes the valve body 33 to close the valve hole 31d. Alternatively, with the swash plate at the minimum inclined angle and the solenoid 25 de-excited as shown in FIG. 7, and when the start switch 57 is turned on or the accelerator switch 58 is turned on, the solenoid 25 is excited and the movable iron core 29 is attracted to the fixed iron core 28. Even in this case, the bellows 46 contracts due to the influence of the suction pressure on the detecting chamber 43, causing the valve body 33 to close the valve hole 31d.

There are differences among pressures in the discharge chamber 3b, the crank chamber 2a and the suction chamber 3a. When the valve body 33 closes the valve hole 31d as mentioned above, therefore, the pressure in the crank chamber 2a falls, thus increasing the inclined angle of the swash plate. At this time, although the swash plate support 14 moves in the direction away from the spool 21, the spool 21 moves in response to the support 14 due to the force of the spring 36. The distal end of the small diameter portion 21b gradually moves away from the restricting surface 55. Consequently, the amount of the refrigerant gas flowing from the suction passage 54 into the suction chamber 3a, and then into the cylinder bores 1a increases gradually, as does the discharge displacement and the discharge pressure Pd. When the difference between the discharge pressure Pd and the suction pressure Ps exceeds the predetermined value $\Delta P$, the discharge control valve 60 starts opening. With the gradual opening of the ports 61a and 61b, however, the discharge pressure will not drastically change over a short period of time. The torque in the compressor does not therefore vary significantly within a short period of time.

Figure 9:
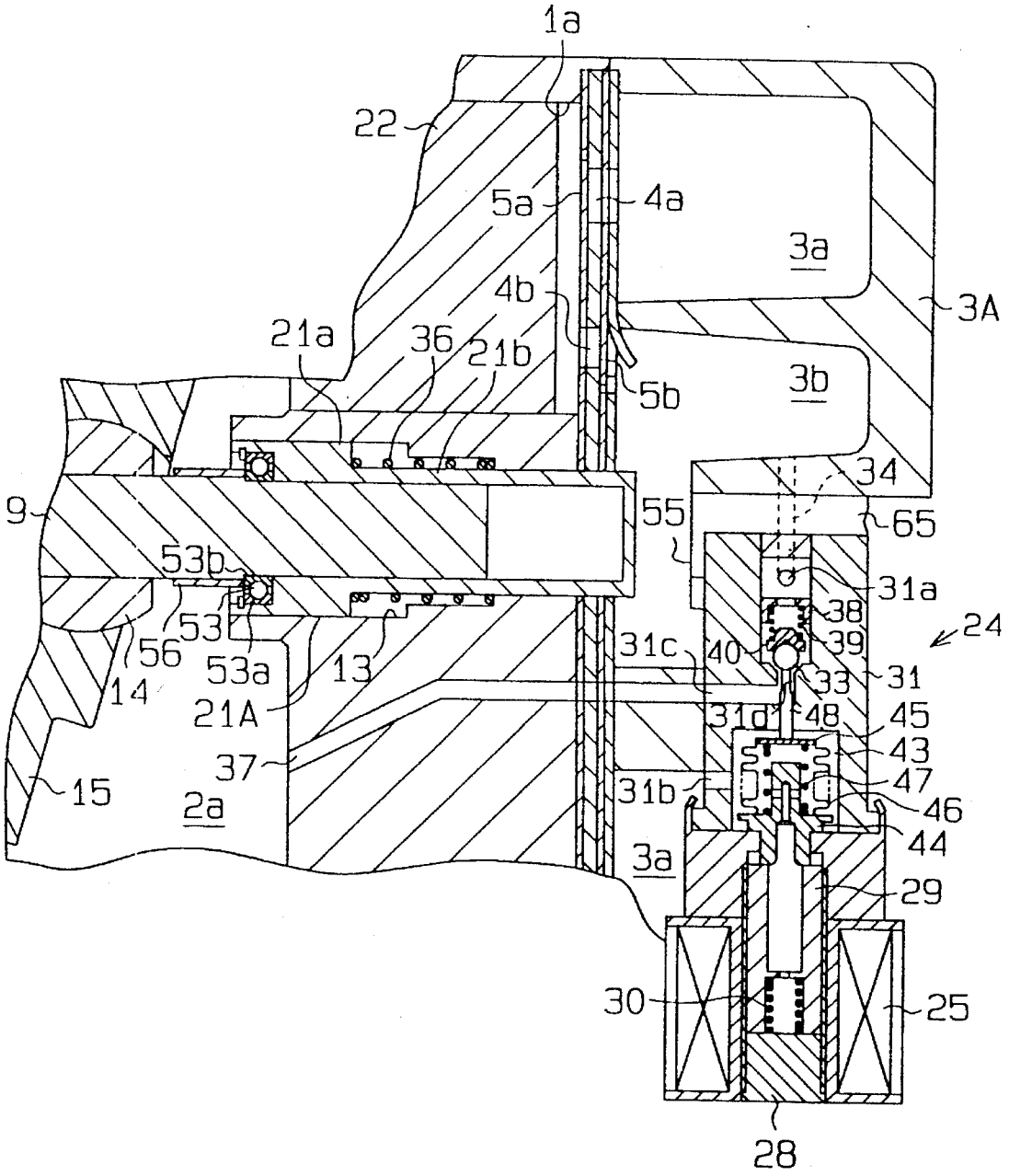
FIG. 9 is an enlarged fragmentary cross-sectional view showing another embodiment of the present invention.
Figure 10:
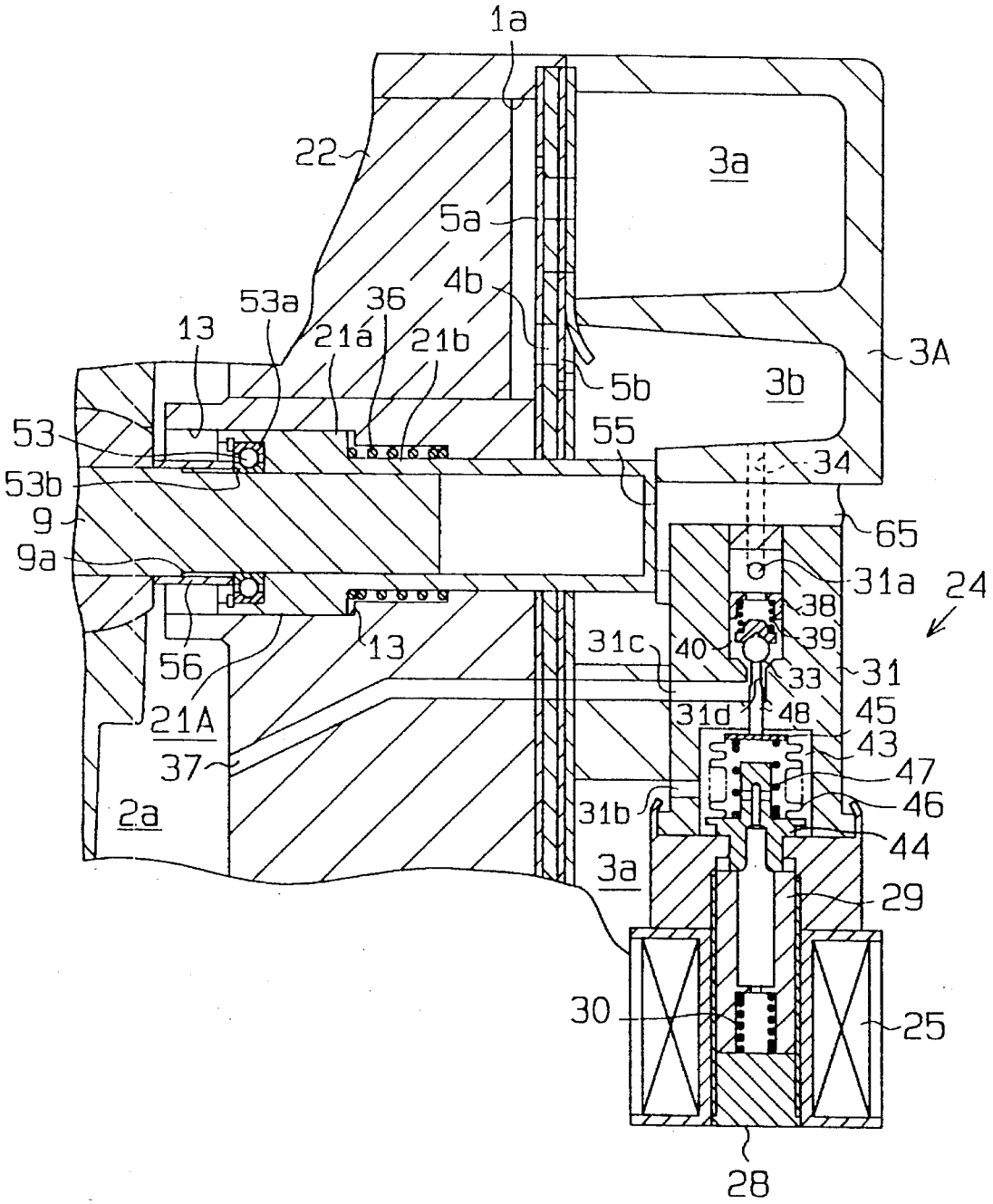
FIG. 10 is an enlarged fragmentary cross-sectional view showing the suction passage closed by the spool of FIG. 9.

The present invention is not limited to the above-described embodiment, but may be embodied in the forms shown in FIGS. 9 and 10.

In this embodiment, the suction chamber 3a is formed in the outer surface portion of a rear housing 3A, and the discharge chamber 3b is formed in the center portion. The suction valve 5a and the suction port 4a are located in the center portion of the compressor, and the discharge valve 5b and the discharge port 4b are located at the outer surface portion of the compressor. A spool 21A, like the one in the previous embodiment, is responsive to a change in the inclined angle of the swash plate 15, and blocks an exhaust port 65 when the inclined angle of the swash plate 15 is minimum. The crank chamber 2a is connected to the suction chamber 3a via a pressure release passage (not shown).

FIG. 9 shows the spool 21A placed at an open position with the spool 21A in this position, the refrigerant gas in the discharge chamber 3b can flow to the external refrigerant circuit 49. FIG. 10 shows the spool 21A placed at a closed position, at which the refrigerant gas in the discharge chamber 3b cannot flow to the external refrigerant circuit 49. Even in this embodiment, when the inclined angle of the swash plate is minimized, the exhaust port 65 is gradually restricted. This not only prevents the discharge pressure from undergoing any rapid change, but also prevents torque in the compressor from varying significantly within a short period of time.

Therefore, the present examples and embodiments are to be considered as illustrative and not restrictive and the invention is not to be limited to the details given herein, but may be modified within the scope of the appended claims.

What is claimed is:

1. A compressor having a refrigerant gas passage selectively connected to and disconnected from a refrigerant circuit separately provided from the compressor, said compressor having a plurality of pistons reciprocable in a housing for compressing refrigerant gas, said compressor comprising:

a drive shaft rotatably supported by the housing;

a swash plate supported on the drive shaft for integral rotation with inclining motion with respect to the drive shaft to drive the pistons, said swash plate being movable between a maximum inclined angle and a minimum inclined angle;

disconnecting means for disconnecting said refrigerant circuit from the refrigerant gas passage when the swash plate is at the minimum inclined angle; and bleeding means for bleeding the refrigerant gas from the refrigerant gas passage to the refrigerant circuit to suppress rapid increase of the inclined angle when the disconnecting means operates.

2. A compressor according to claim 1 further comprising control means for controlling the inclined angle of the swash plate in accordance with the pressure of the refrigerant gas sucked from the refrigerant circuit into the refrigerant gas passage.

3. A compressor according to claim 2, wherein said disconnecting means is disposed downstream of a position where the pressure of the refrigerant gas is detected in the refrigerant gas passage.

4. A compressor according to claim 3, wherein a computer apart from the compressor is electrically connected to the compressor, said computer computing conditions relating to the operation of the compressor.

5. A compressor according to claim 4, wherein said computer outputs electric signals indicative of the operating conditions of the compressor to the control means in order to drive the control means.

6. A compressor having a refrigerant gas passage connected to a refrigerant circuit separately provided from the compressor, said compressor having a plurality of reciprocable pistons for compressing refrigerant gas, said compressor comprising:

a housing having a refrigerant discharge chamber and a refrigerant suction chamber;

a crank chamber disposed in the housing;

a plurality of cylinder bores disposed in the housing, said cylinder bores communicating the discharge chamber and the suction chamber, and each of said cylinder bores accommodating one of the pistons;

a drive shaft rotatably supported by the housing;

a swash plate supported on the drive shaft for integral rotation with inclining motion with respect to the drive shaft in the crank chamber to drive the pistons, said swash plate being movable between a maximum inclined angle and a minimum inclined angle;

disconnecting means for disconnecting the refrigerant circuit from the refrigerant gas passage when the swash plate is at the minimum inclined angle; and bleeding means for allowing the refrigerant gas to bleed from the refrigerant gas passage to the refrigerant circuit to avoid rapid increase of the inclined angle when the disconnecting means operates.

7. A compressor according to claim 6, wherein said refrigerant gas passage includes:

a first passage for connecting the crank chamber and the suction chamber to deliver the refrigerant gas from the crank chamber to the suction chamber;

a second passage for connecting the discharge chamber and the crank chamber to deliver the refrigerant gas from the discharge chamber to the crank chamber; and a circulating passage including the first passage and the second passage, said circulating passage being formed upon disconnection of the refrigerant circuit and the refrigerant gas passage.

8. A compressor according to claim 7, wherein said refrigerant gas passage further includes:

a suction passage for connecting the refrigerant circuit and the suction chamber for supplying the refrigerant gas from the refrigerant circuit to the suction chamber; and a discharge port for connecting the discharge chamber and the refrigerant circuit for discharging the refrigerant gas from the discharge chamber to the refrigerant circuit.

9. A compressor according to claim 8 further comprising control means for controlling the inclined angle of the swash plate in accordance with the pressure of the refrigerant gas sucked from the refrigerant circuit into the refrigerant gas passage.

10. A compressor according to claim 9, wherein said disconnecting means is disposed downstream of the control means in the refrigerant gas passage.

11. A compressor according to claim 9, wherein said control means includes a first valve for opening the second passage in accordance with the pressure of the refrigerant gas supplied from the refrigerant circuit to the suction chamber via the suction passage.

12. A compressor according to claim 11 further comprising actuating means for actuating the first valve.

13. A compressor according to claim 12, wherein said computer is connected to the actuating means, said computer computing conditions relative to the operation of the compressor.

14. A compressor according to claim 13, wherein said computer outputs electric signals indicative of the operational conditions of the compressor to the actuating means in order to drive the actuating means.

15. A compressor according to claim 8 further comprising:

a control passage for connecting the suction passage and the discharge chamber to deliver the refrigerant gas in the suction passage to the discharge chamber; and a second valve disposed between the control passage and the discharge port for selectively opening and closing the discharge port in accordance with the pressure of the refrigerant gas in the suction passage and the pressure of the refrigerant gas in the discharge chamber.

16. A compressor according to claim 6, wherein said disconnecting means includes a movable member supported in the housing, said movable member being disposed movably along the refrigerant gas passage.

17. A compressor according to claim 16, wherein said movable member is movable on the drive shaft along the axial direction of the drive shaft, said movable member moving in accordance with change of the inclined angle and closing between the suction chamber and the suction passage when the swash plate is at the minimum inclined angle.

18. A compressor according to claim 17, wherein said movable member substantially closes between the suction passage and the first passage when the swash plate is at the minimum inclined angle.

19. A compressor according to claim 17, wherein said bleeding means includes a bleed hole formed in the movable member for connecting the first passage and the suction passage.

20. A compressor operated in accordance with operation conditions computed by a computer electrically connected to the compressor, and having a refrigerant gas passage connected to a refrigerant circuit separately provided from the compressor, said compressor having a plurality of reciprocable pistons for compressing refrigerant gas, said compressor comprising:

a housing having a refrigerant discharge chamber and a refrigerant suction chamber;

a crank chamber disposed in the housing;

a plurality of said cylinder bores disposed in the housing, said cylinder bores communicating the discharge chamber and the suction chamber, and each of cylinder bores accommodating one of the pistons;

a drive shaft rotatably supported by the housing;

a swash plate supported on the drive shaft for integral rotation with inclining motion with respect to the drive shaft in the crank chamber to drive the pistons, said swash plate being movable between a maximum inclined angle and a minimum inclined angle;

a first passage for connecting the crank chamber and the suction chamber to deliver the refrigerant gas from the crank chamber to the suction chamber;

a second passage for connecting the discharge chamber and the crank chamber to deliver the refrigerant gas from the discharge chamber to the crank chamber;

a suction passage for connecting the refrigerant circuit and the suction chamber for supplying the refrigerant gas from the refrigerant circuit to the suction chamber;

a discharge port for connecting the discharge chamber and the refrigerant circuit for discharging the refrigerant gas from the discharge chamber to the refrigerant circuit;

control means for controlling the drive the swash plate in accordance with electric signals indicative of the operating conditions of the swash plate, said computer outputting said electric signals;

disconnecting means for disconnecting the refrigerant circuit from the refrigerant gas passage when the swash plate is at the minimum inclined angle;

bleeding means for allowing the refrigerant gas to bleed from the refrigerant gas passage to the refrigerant circuit to avoid rapid increase of the inclined angle when the disconnecting means operates; and a circulating passage including the first passage and the second passage, said circulating passage being formed upon disconnection of the refrigerant circuit and the refrigerant gas passage.

21. A compressor according to claim 20, wherein said disconnecting means is disposed downstream of the control means in the refrigerant gas passage.

22. A compressor according to claim 21, wherein said control means includes a first valve for opening the second passage in accordance with the pressure of the refrigerant gas supplied from the refrigerant circuit to the suction chamber via the suction passage.

23. A compressor according to claim 22 further comprising actuating means for actuating the first valve.

24. A compressor according to claim 23 wherein said actuating means includes an electromagnetic valve.

25. A compressor according to claim 20, wherein said disconnecting means includes a movable member supported in the housing, said movable member being disposed movably along the refrigerant gas passage.

26. A compressor according to claim 25, wherein said movable member substantially closes between the suction passage and the first passage when the swash plate is at the minimum inclined angle.

27. A compressor according to claim 26, wherein said movable member substantially closes between the suction passage and the first passage when the swash plate is at the minimum inclined angle.

28. A compressor according to claim 27, wherein said bleeding means includes a bleed hole formed in the movable member for connecting the first passage and the suction passage.

* * * * *

UNITED STATES PATENT AND TRADEMARK OFFICE

CERTIFICATE OF CORRECTION

PATENT NO. : 5,577,894
DATED : November 26, 1996
INVENTOR(S) : M. Kawaguchi et al It is certified that error appears in the above-indentified patent and that said Letters Patent is hereby corrected as shown below:

Column 1, line 9, after "COMPRESSOR" insert --now issued--.

Column 2, line 36, start new paragraph at "This".

Column 4, line 1, after "plate" insert --8--.

Column 5, line 6, "1a" should read --1a--.

Column 13, line 1, delete "said";

Signed and Sealed this

First Day of April, 1997

*Attest:*

*Attesting Officer*

BRUCE LEHMAN

*Commissioner of Patents and Trademarks*